US007694622B2

(12) United States Patent
Jeter et al.

(10) Patent No.: US 7,694,622 B2
(45) Date of Patent: Apr. 13, 2010

(54) FLUID PRESSURE OPERATED PISTON ENGINE APPARATUS AND METHOD

(75) Inventors: David R. Jeter, Woodstock, GA (US); Robert J. Woodlief, Suwanee, GA (US)

(73) Assignee: Nordson Corporation, Westlake, OH (US)

( * ) Notice: Subject to any disclaimer, the term of this patent is extended or adjusted under 35 U.S.C. 154(b) by 231 days.

(21) Appl. No.: 11/934,900

(22) Filed: Nov. 5, 2007

(65) Prior Publication Data

US 2008/0127946 A1 Jun. 5, 2008

Related U.S. Application Data

(60) Provisional application No. 60/868,175, filed on Dec. 1, 2006.

(51) Int. Cl.
*F01L 25/08* (2006.01)
*F01L 31/02* (2006.01)

(52) U.S. Cl. ..... 91/275; 91/344

(58) Field of Classification Search ..... 91/275, 91/286, 287, 344

See application file for complete search history.

(56) References Cited

U.S. PATENT DOCUMENTS 5,243,897 A * 9/1993 Walton et al. ..... 91/344
5,325,762 A 7/1994 Walsh et al.

* cited by examiner

*Primary Examiner*—Michael Leslie
(74) *Attorney, Agent, or Firm*—Wood, Herron & Evans, L.L.P.

(57) ABSTRACT

A fluid pressure operated piston engine apparatus generally includes a piston unit, a valve configured to selectively direct pressurized fluid into the piston unit, a valve shifting mechanism, and a magnetic detent device. The magnetic detent device includes a valve actuating member coupled to a valve element in the valve. The valve actuating member is movable between first and second magnetically held positions respectively holding the valve element in first and second positions. The valve shifting mechanism includes a biasing device operatively connected to a shaft associated with the piston unit. As the shaft approaches the first and second ends of its stroke, the biasing forces are used at least partially overcome magnetic attraction holding the valve actuating member. In this manner, the valve actuating member moves between first and second magnetically held positions to cause the valve element to shift and redirect pressurized fluid into the piston chamber of the piston unit to effect reversal of the direction of travel of the shaft.

18 Claims, 6 Drawing Sheets

FLUID PRESSURE OPERATED PISTON ENGINE APPARATUS AND METHOD

This application claims the benefit of Application Ser. No. 60/868,175, filed Dec. 1, 2006 (pending), the disclosure of which is hereby incorporated by reference herein.

TECHNICAL FIELD

The present invention generally relates to fluid pressure operated piston engines, such as piston pumps, and specifically to shifters used to change the direction of the piston in such apparatus.

BACKGROUND

Double stroke pistons are used in a variety of different types of industrial applications, such as for pumping heated adhesives or performing other work. Moving the piston in each direction may be accomplished by directing a pressurized fluid through a fluid valve, such as an air valve. Typically, pressurized air is directed into a piston chamber via an air valve having a valve element moveable between two positions. In the first position, the pressurized air is directed to one side of the piston within the piston chamber and in the second position the pressurized air is redirected to the other side of the piston within the piston chamber. The piston and a connected piston shaft therefore move in one direction or the other depending on the side of the piston against which the pressurized air is directed. In various prior piston pumps, the piston shaft is connected to a shifter device through a fork or other connecting member. One example is disclosed in U.S. Pat. No. 5,325,762, which is assigned to the assignee of the present invention. As the piston and shaft approach the respective first and second ends of the stroke, the shifter device is moved through magnetic force generated between magnets on the shifter device and on the fork. This causes the valve element to shift between the first and second positions. The process repeats itself at each end of the piston stroke to continuously change the direction of the piston and shaft during, for example, a pumping operation.

A continuing need for improvements in the technology related to shifting mechanisms exists. For example, some mechanisms are relatively complex, or use multiple permanent magnets, or have other needs for improvement. Further, it is desirable to ensure that the shifting mechanisms remain operative and reliable for millions of strokes in a wide variety of applications, including in some cases high temperature environments associated with pumping heated adhesives or so-called hot melt adhesives.

SUMMARY

In one aspect of the invention a fluid pressure operated piston engine apparatus generally includes a fluid pressure operated piston unit, a valve, a valve shifting mechanism, and a magnetic detent device. The fluid pressure operated piston unit includes a piston chamber, a piston mounted for reciprocation within the piston chamber, and a shaft coupled with the piston. In this manner, the piston and the shaft reciprocate together along a stroke having first and second ends. The valve is configured to selectively direct pressurized fluid into the piston chamber on opposite first and second sides of the piston. The valve includes a valve element movable between (i) a first position in which the valve directs the pressurized fluid into the piston chamber on the first side of the piston to move the shaft toward the first end of the stroke, and (ii) a second position in which the valve directs the pressurized fluid into the piston chamber on the second side of the piston to move the shaft toward the second end of the stroke. The valve shifting mechanism operatively couples the shaft to the valve element and includes a biasing device providing a first biasing force as the shaft approaches the first end of the stroke and a second biasing force as the shaft approaches the second end of the stroke. The magnetic detent device includes a valve actuating member coupled to the valve element and moveable between first and second magnetically held positions. In this regard, "coupled to" encompasses two parts, such as an actuating member and valve element, that are integral with each other or an assembly of separate components. The first and second magnetically held positions respectively hold the valve element in its first and second positions. As the shaft approaches the respective first and second ends of the stroke, the respective first and second biasing forces are used at least partially to overcome magnetic attraction holding the valve actuating member. In this manner, the valve actuating member moves between the first and second magnetically held positions and causes the valve element to shift. This redirects the pressurized fluid into the piston chamber to effect reversal of the travel of the shaft.

In another aspect of the invention, apparatus for pumping heated adhesives is provided. In this embodiment, the apparatus may be constructed substantially as described immediately above and the shaft may be utilized as part of a pump. Additionally, the valve is mounted externally to the piston chamber, and the valve, valve shifting mechanism, and magnetic detent device are all capable of operating at temperatures of at least 350° F.

A method of operating a double stroke piston including a piston coupled with a shaft may include directing pressurized air through a valve including a valve element held in a first position by a magnetic force. The air is further directed against a first side of the piston to move the shaft toward the first end of its stroke. The method can further include actuating a biasing device to apply a biasing force to the valve element as the shaft approaches the first end of the stroke. The magnetic force is then overcome at least partially by using the biasing force such that the valve element shifts and air is redirected through the valve and against a second, opposite side of the piston to move the shaft in an opposite direction toward a second end of the stroke.

Various additional combinations, features and advantages of the invention will become more readily apparent to those of ordinary skill in the art upon review of the following detailed description of illustrative embodiments taken in conjunction with the accompanying drawings.

DETAILED DESCRIPTION OF THE ILLUSTRATIVE EMBODIMENTS

Figure 1:
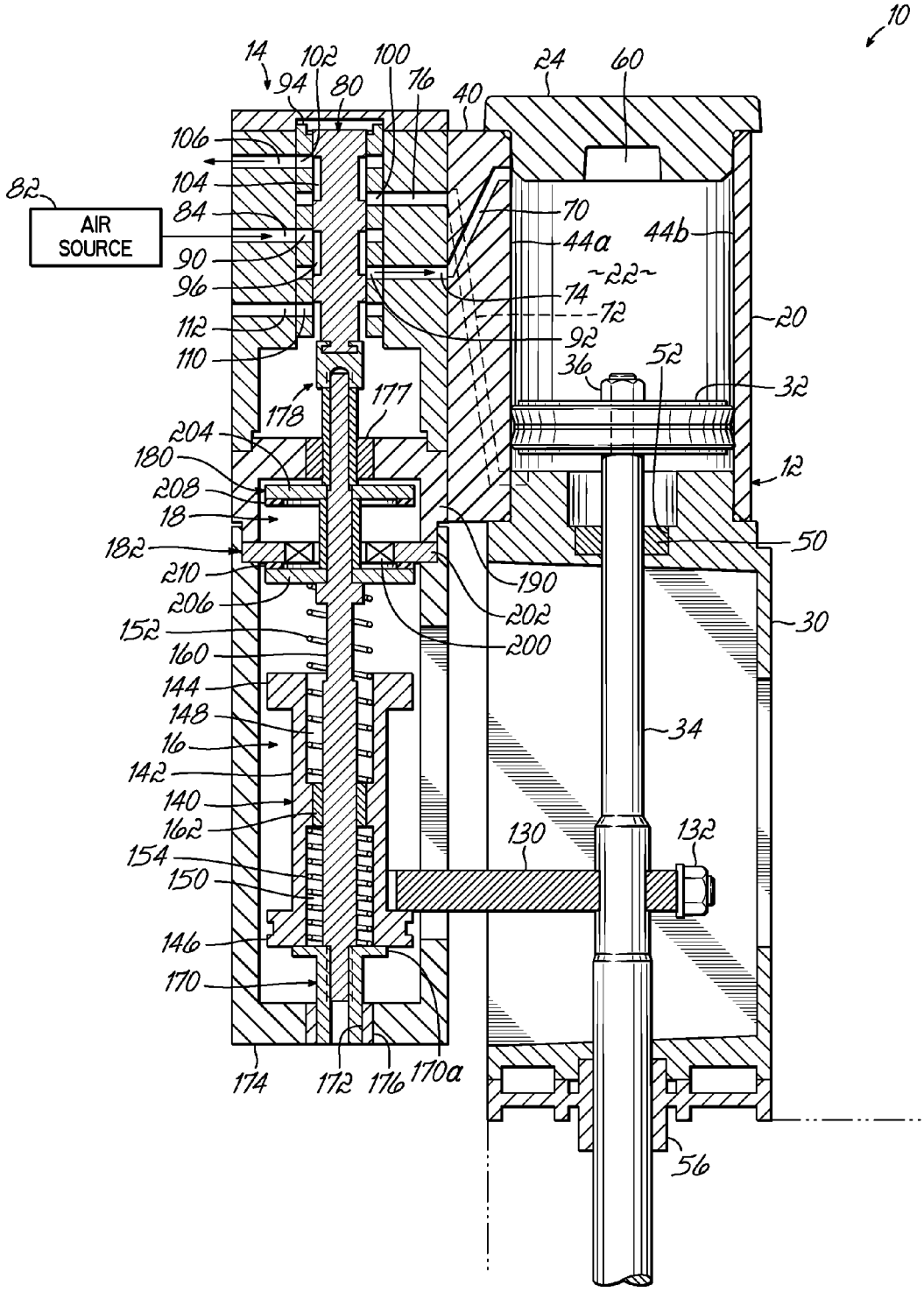
FIG. 1 is a longitudinal cross-sectional view of an illustrative pneumatic double stroke piston apparatus constructed in accordance with a first embodiment and showing the piston generally at a first end of its stroke.

FIGS. 1-4 illustrate an example of a fluid pressure operated piston engine apparatus 10 generally including a piston unit or pneumatic cylinder 12, a valve 14, a valve shifting mechanism 16, and a magnetic detent device 18. It should be noted that all directional references used herein are for convenience of description only and that apparatus 10 may be used in various orientations. The piston unit 12 generally includes an upper piston housing 20 defining an interior piston chamber 22. The piston housing 20 is sealed on one end by a cap 24 and is sealed on an opposite end by a portion of a lower housing 30. A piston 32 is mounted for reciprocation within the piston chamber 22 and is rigidly connected to a shaft 34 by way of a threaded nut 36. Shaft 34 may be used as a pump for pumping liquid hot melt adhesive material. A connecting member 40 connects the piston housing 20 to the valve 14 and, together, the piston housing 20 and connecting member 40 provide interior cylindrical walls 44*a*, 44*b* against which the piston 32 slides with at least a substantially airtight seal. The shaft 34 is supported at opposite ends of the lower housing 30 for reciprocation with the piston 32. An air seal 50 may be pressed into a recess 52 at an upper end of the lower housing 30. The air seal 50 provides at least a substantially airtight seal against the moving shaft 34 to allow retention of the air pressure within the piston chamber 22. An alignment member 56 is also provided at a lower end of housing 30. A recess 60 may be provided in the cap 24 to allow for clearance of the nut 36 at the second or upper end of the stroke. The various components of apparatus 10 may be manufactured to operate effectively at temperatures of at least 350° F., in accordance with the disclosure of U.S. Pat. No. 5,325,762, which is hereby incorporated by reference herein.

Referring to FIG. 1, the valve 14 is fluidly coupled to the piston chamber 22 by way of a pair of air passageways 70, 72 in the connecting member 40 that couple to respective air passageways 74, 76 in the valve 14. As shown in FIG. 1, when pressurized air is directed through the passageway 74 into the piston chamber 22 the pressurized air forces the piston 32 downward. When pressurized air directed through the passageway 76 into the piston chamber 22 the piston 32 is forced in an opposite, upward direction. Whether the pressurized air is directed through the passageway 74 or the passageway 76 depends on the position of a movable valve element 80. In the illustrative embodiment, the valve element 80 can be reciprocated back and forth. In the position shown in FIG. 1, the valve element 80 is moved to its uppermost position to connect a source of pressurized air 82 to the passageway 74 via an input port 84. The pressurized air travels through respective ports 90, 92 in a stationary sleeve or valve element holder 94, and through an annular groove 96 extending around the outer surface of the valve element 80 to reach passageway 74. As the piston is moving downwardly, air beneath the piston 32 is exhausted through passageways 72 and 76 and then through respective ports 100, 102 in the sleeve 94 and an upper annular groove 104 in the valve element in a flow path leading to an upper exhaust port 106.

Figure 2:
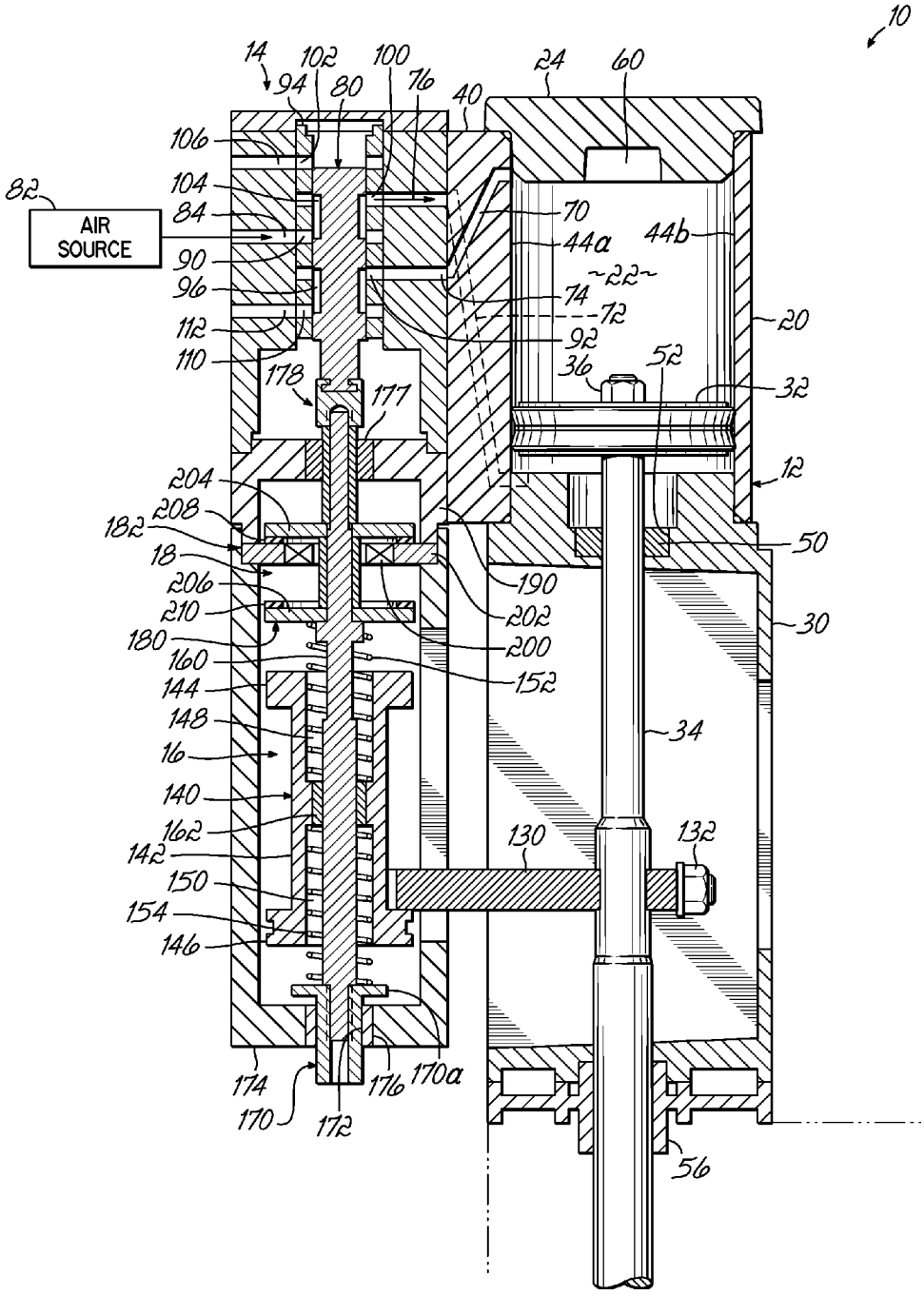
FIG. 2 is a cross-sectional view similar to FIG. 1, but illustrating a different position of the shifting mechanism caused by a fork reciprocating with the piston shaft to initiate movement of the piston in an opposite direction.

When the valve element 80 is moved to its lower position, as shown in FIG. 2, the pressurized air source 82 is directed via the input port 84 through ports 90, 100 and annular groove 104 in the valve element 80. The air then travels into the piston chamber 22 via passageway 76 and passageway 72 to initiate upward movement of the piston 32. Air in the chamber 22 on the upper side of the piston 32 will be exhausted through a lower exhaust port 112 by being directed through passageways 70, 74, ports 92, 110, annular groove 96 and the lower exhaust port 112.

Referring to FIGS. 1-5, to facilitate shifting of the valve element 80 as just described, the piston shaft 34 is connected to the valve shifting mechanism 16 by way of a connecting member, such as a fork 130, that may be secured to the shaft 34 through the use of a threaded nut 132. The valve shifting mechanism 16 includes a biasing device 140 that may take the form of a generally cylindrical spool 142 having upper and lower flanges 144, 146, and upper and lower interior spaces 148, 150 for holding respective first and second coil springs 152, 154. The spool 142 surrounds and slides along a valve actuating member 160. For this purpose, a slide bushing 162 may be provided generally centrally on the spool 142. The valve actuating member 160 is connected at a lower end to a stop member 170 so as to move therewith, and the stop member 170 may slide through a lower opening 172 in the shifting mechanism housing 174. To facilitate this sliding movement, a sleeve 176 may be provided as shown. An upper end of the valve actuating member 160 is supported by a sleeve bearing 177 and is coupled to the valve element 80 by, for example, a connecting assembly 178. Connecting assembly 178 will allow a small amount of side-to-side or radial "play" or movement to accommodate any small misalignments of components generally along valve element 80 and actuating member 160.

Figure 5:
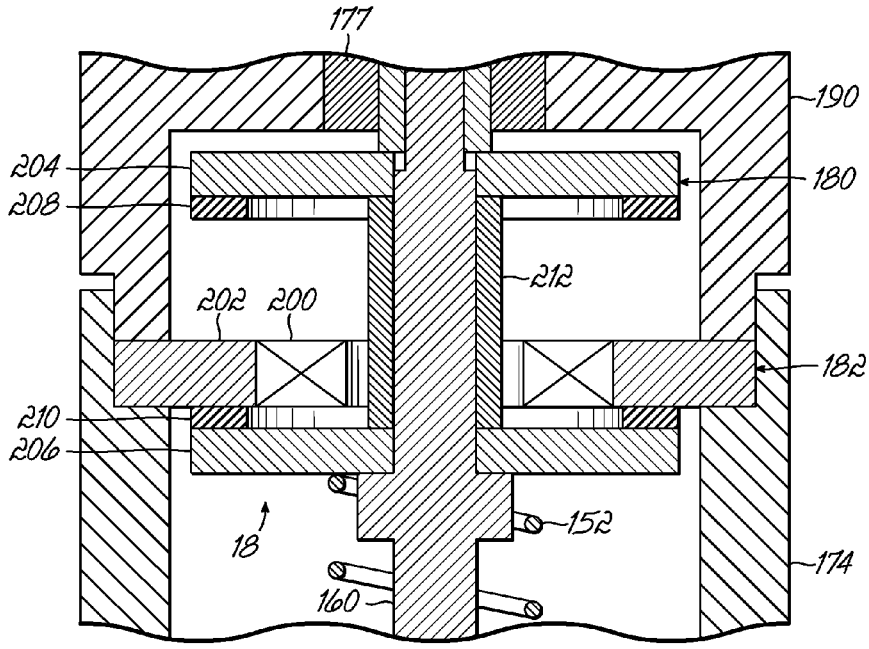
FIG. 5 is an enlarged cross-sectional view of the magnetic detent device shown in FIG. 1.

Referring most particularly to FIG. 5, a moveable portion 180 of the magnetic detent device 18 is fixed to the valve actuating member 160 for movement between a first position shown in FIG. 1 and a second position shown in FIG. 2. A stationary portion 182 of the magnetic detent device 18 may be fixed in position, for example, between the valve shifting mechanism housing 174 and a housing 190 generally containing the magnetic detent device 18. The magnetic detent housing 190, in turn, is fixed to the valve 14 (FIG. 1). In the embodiment shown, the fixed or stationary portion 182 of the magnetic detent device 18 may be a permanent magnet 200 bonded within a support plate 202, while the moveable portion 180 may comprise first and second spaced apart members, such as plates 204, 206. These plates 204, 206 may have respective resilient bumpers 208, 210 for lessening the impact with the fixed portion 182 of the magnetic detent device 18. Bumpers 208, 210 may alternatively be mounted to opposite sides of the magnetic member 200 and/or on support plate 202, or may of course be eliminated if deemed unnecessary. A sleeve 212 may be used to space the plates 204, 206 apart and fix the plates 204, 206 for movement with the valve actuating member. These magnetic members 200, 204, 206 may, for example, comprise carbon steel or other metallic plates 204, 206 that are magnetically attracted to a permanent magnet 200. It will be appreciated, that, for example, both the moveable portion 180 and the fixed portion 182 of the magnetic detent device 18 may be formed of permanently magnetic material, or that the moveable portion 180 of the device may be formed of permanently magnetic material, while the fixed portion 182 is formed from a metal that is magnetically attracted to the permanently magnetic material. In this regard, the use of the term "magnetic" is meant to encompass either permanently magnetic materials or metals, such as ferrous metals, that are attracted to permanently magnetic material, as long as a combination is used that results in magnetic attraction in general accordance herewith.

When pressurized air is directed from the air source 82 through the valve 14 and through the passageway 72 into the chamber 22, as shown schematically in FIG. 1, the piston 32 and shaft 34 will move downwardly toward a first end of the stroke. Nearing the first end of the stroke, the fork 130 will contact the lower flange 146 of the spool 142 and begin to compress the lower spring 154 thereby imparting a biasing force on the stop element 170. This therefore imparts a downward force on the valve actuating member 160, movable portion 180 of detent 18 and valve element 80 all of which are connected together. At the point in time illustrated in FIGS. 1 and 5, the movable portion 180 of the magnetic detent device 18 is in its upper position thus holding the valve element 80 in its first or upper position by way of magnetic attraction between the lower plate 206 and the fixed magnetic member 200. As the biasing force created by the lower spring 154 increases, it can overcome the magnetic attraction between the plate 206 and the fixed magnetic member 200 and cause the plate 206 to move or shift away from the fixed magnetic member 200 and the second plate 204 to move downward toward and ultimately stop against the fixed magnetic member 200. Magnetic attraction will then hold the second plate 204 against the fixed magnetic member 200. Since the moveable magnetic members 204, 206 are fixed to each other and fixed rigidly to the valve actuating member 160 and valve element 80, this will shift the valve element 80 to its second or lower position as shown in FIG. 2. Although FIG. 1 illustrates direct contact between the moveable spool 142 and an upper flange 170*a* of the stop member 170, it will be appreciated that direct contact and any resulting physical force generated by the contact may not be necessary for the valve element 80 to shift. However, direct contact may be used as a backup in case the biasing force alone is not enough to shift the magnetic detent device 18 due to, for example, sticking of the valve element 80.

Figure 3:
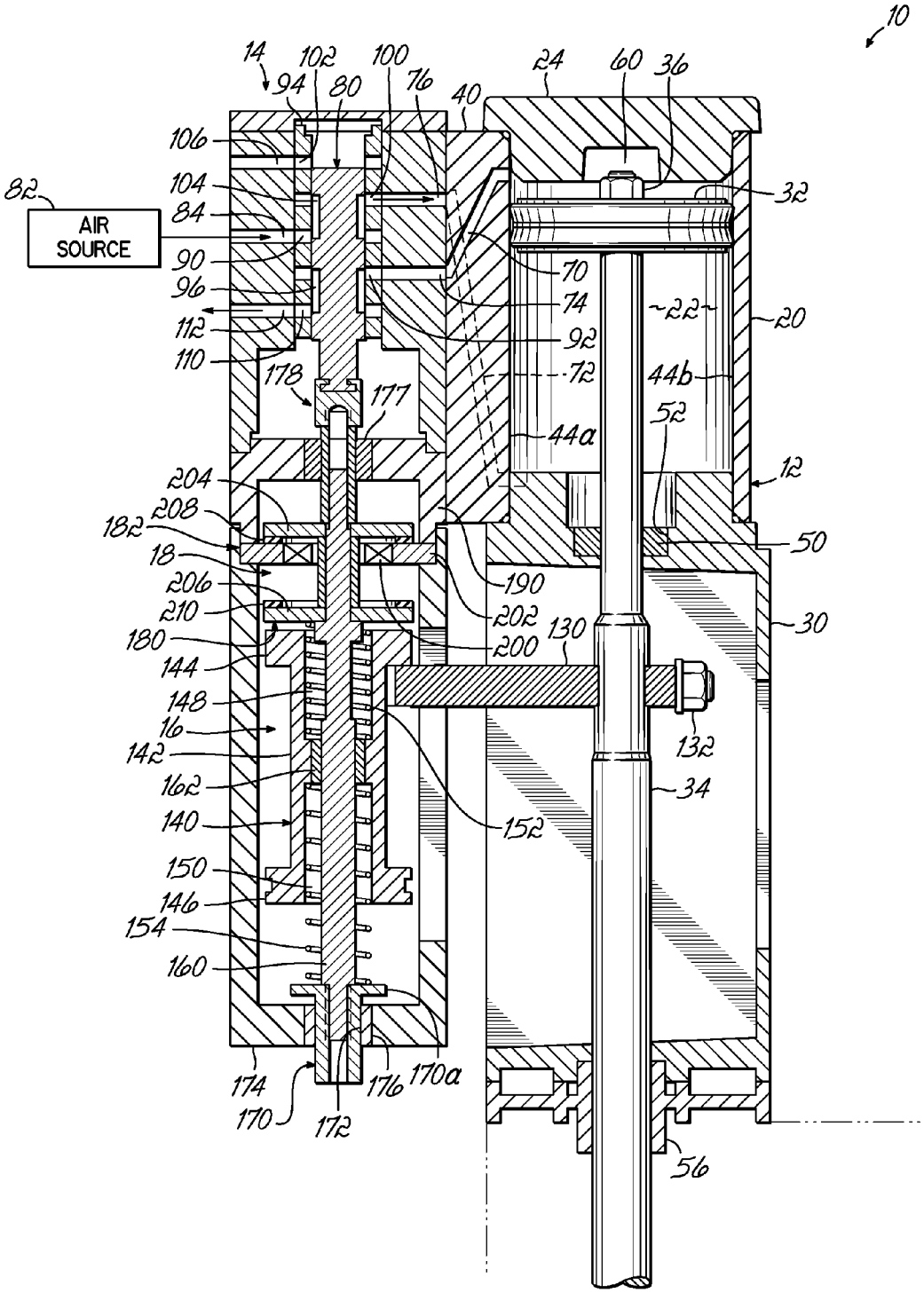
FIG. 3 is a cross-sectional view similar to FIG. 2, but illustrating the piston approaching the second end of the stroke just prior to movement or actuation of the shifting mechanism by the fork.
Figure 4:
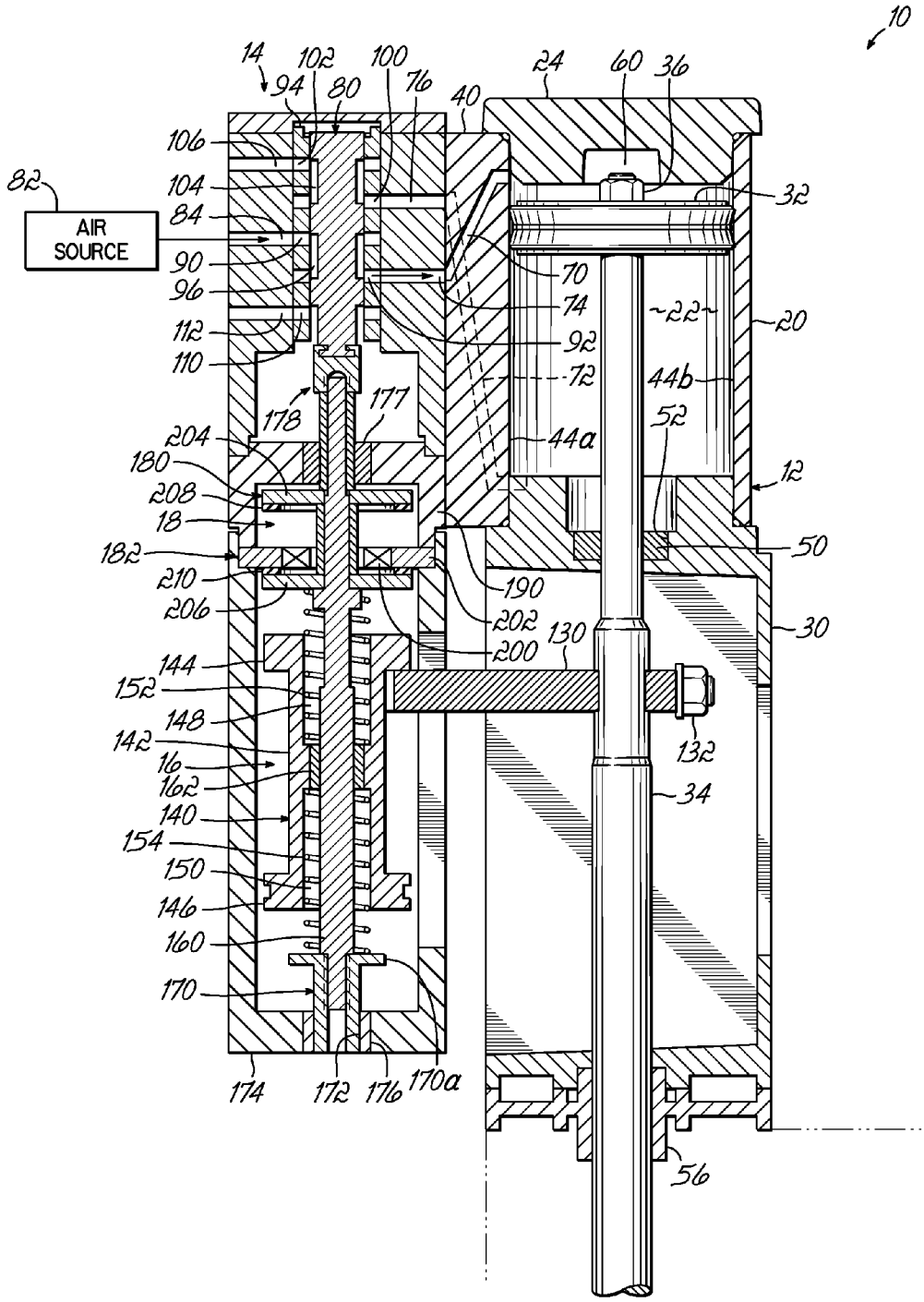
FIG. 4 is a cross-sectional view similar to FIG. 3, but illustrating the change in position of the magnetic detent device and actuation of the valve to redirect the pressurized air and effect reversal of the piston.

As shown in FIGS. 3 and 4, the same general procedure occurs at the second or upper end of the stroke. In this regard, at the second or upper end of the stroke, the fork 130 contacts the upper flange 144 of the spool 142 and compresses the upper coil spring 152 as the spool moves with respect to the valve actuating member 160. The upper coil spring 152 thereby imparts an upward biasing force on the lower plate 206 which can overcome the magnetic attraction between the upper moveable magnetic member or plate 204 and the fixed magnetic member 200. At that point in time, as shown in FIG. 4, the spring 152 forces the moveable magnetic members 204, 206 upward such that the lower moveable magnetic member 206 stops against the fixed magnetic member 200 and magnetically holds the valve element 80 in its upward position for once again initiating a reversal of the piston stroke. Although FIG. 3 does not illustrate physical contact between the upper end of the spool 142 and the lower moveable magnetic member or plate 206, it will be appreciated that, again as a backup measure, direct physical contact may occur as an assistive force, for example, in the case of a sticking valve element 80.

Figure 6:
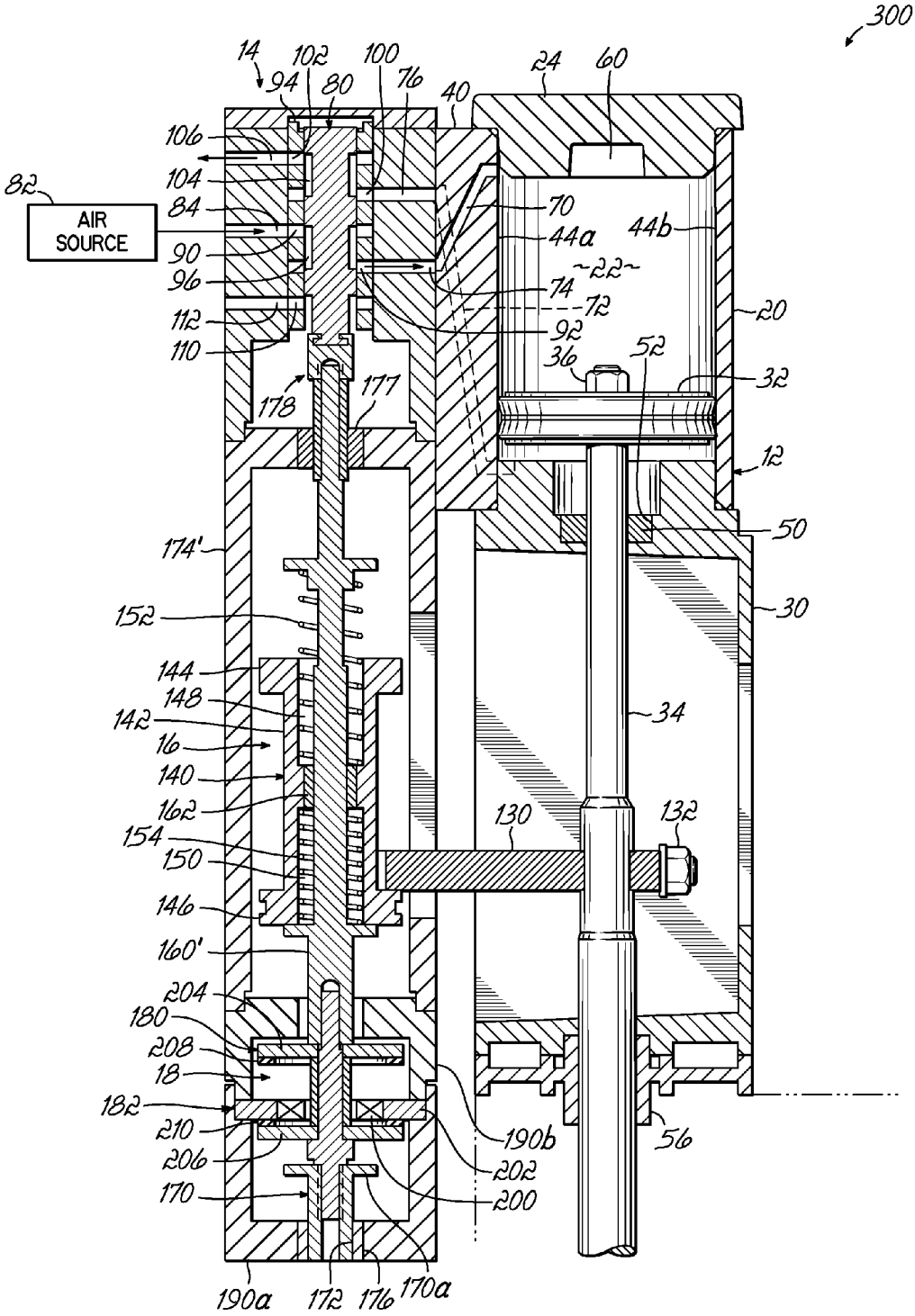
FIG. 6 is a longitudinal cross-sectional view similar to FIG. 1, but illustrating an alternative location for the magnetic detent device.

FIG. 6 illustrates an alternative embodiment of a fluid pressure operated piston engine apparatus 300. In this embodiment, like reference numerals are used to refer to like elements of structure as described above with respect to the first embodiment shown in FIGS. 1-5. Like reference numerals with prime marks (') refer to elements slightly different in design from the corresponding element in the first embodiment as will be readily apparent. Therefore, further detailed discussion of these elements is not necessary. This apparatus is the same as the apparatus described with respect to FIGS. 1-5 except that the location of magnetic detent device 18 has been changed. In this regard, the magnetic detent device 18 is coupled to a lower end of the valve actuating member 160' such that the valve shifting mechanism 16 is located between the valve 14 and the magnetic detent device 18. The magnetic detent device is mounted within respective housing portions 190*a*, 190*b*. The operation of the apparatus 300 is otherwise the same as discussed above.

Figure 7:
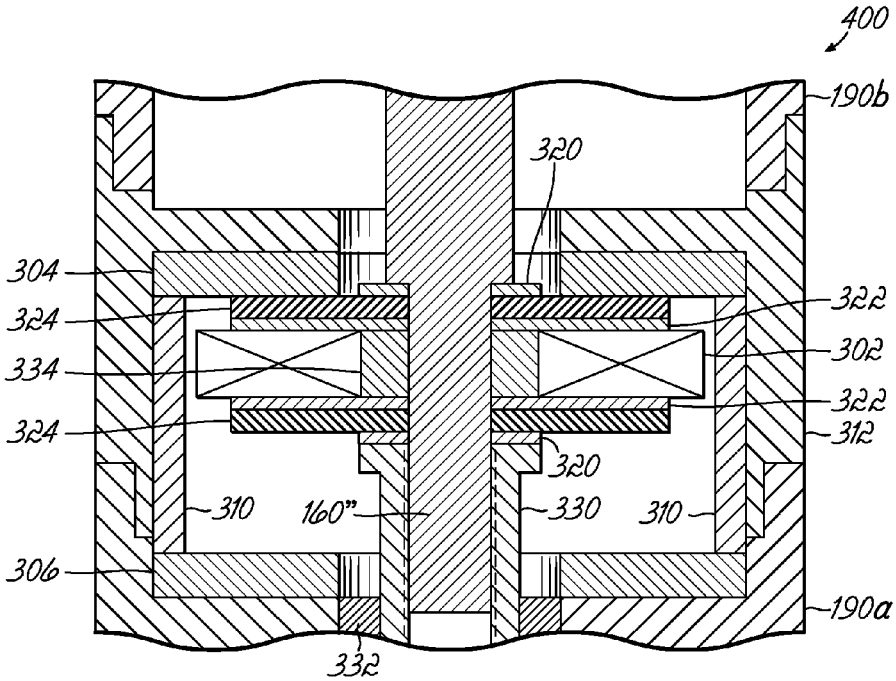
FIG. 7 is a cross-sectional view similar to FIG. 5, but illustrating an alternative embodiment of the magnetic detent device.

FIG. 7 illustrates a magnetic detent device 400 in accordance with an alternative embodiment. In this embodiment, like reference numerals are used to refer to like elements of structure as described above with respect to the second embodiment shown and described in connection with FIG. 6. Like reference numerals with double prime marks (") refer to corresponding elements with a slightly different design as will be readily apparent when comparing FIGS. 6 and 7. Therefore, further detailed information and discussion of these elements is not necessary. In this embodiment, a magnetic member 302, which may be a permanent magnet, is fixed for reciprocating movement with the shaft 160". Respective detents 304, 306 are included in fixed, spaced apart positions. The detents 304, 306 also comprise magnetic members in accordance with the discussion above. A first tubular spacer element 310 may be used to separate and retain the magnetic, fixed detents 304, 306. A second tubular spacer element 312 may be used to fix together the respective housings 190*a*, 190*b*. Washers or rings 320, 322 sandwich resilient bumpers 324 therebetween on each side of the reciprocating magnetic member 302. The entire assembly of rings 320, 322, bumpers 324 and the magnetic member 302 is retained on the reciprocating shaft 160" through the use of a nut 330 slidable within a bushing 332. A spacer 334 may be placed around the shaft 160" and within a central opening of the reciprocating magnetic member 302 to space apart the respective rings 320, 322 and bumpers 324 on opposite sides of the magnetic member 302. As still further alternatives, bumpers or bumper assemblies may be provided on both the fixed and movable magnetic members, or the bumper feature may be eliminated all together. It will be appreciated that the operation of the alternative shown in FIG. 7 will be the same as described above with respect to FIG. 6 except that one magnetic member will be moving between two fixed magnetic members instead of vice versa.

While the present invention has been illustrated by a description of various preferred embodiments and while these embodiments has been described in some detail, it is not the intention of the Applicants to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with the preferred methods of practicing the present invention as currently known. However, the invention itself should only be defined by the appended claims, wherein what is claimed is:

What is claimed is:

1. A fluid pressure operated piston engine apparatus, comprising:

a fluid pressure operated piston unit including a piston chamber, a piston mounted for reciprocation within said piston chamber, and a shaft coupled with said piston such that said piston and said shaft reciprocate together along a stroke having first and second ends;

a valve configured to selectively direct pressurized fluid into said piston chamber on opposite first and second sides of said piston, said valve including a valve element movable between (i) a first position in which said valve directs the pressurized fluid into said piston chamber on the first side of said piston to move said shaft toward the first end of the stroke, and (ii) a second position in which said valve directs the pressurized fluid into said piston chamber on the second side of said piston to move said shaft toward the second end of the stroke;

a valve shifting mechanism operatively coupling said shaft to said valve element, said valve shifting mechanism including a biasing device providing a first biasing force as said shaft approaches the first end of the stroke and a second biasing force as said shaft approaches the second end of the stroke; and a magnetic detent device including a valve actuating member coupled to said valve element and moveable between first and second magnetically held positions respectively holding said valve element in its first and second positions, wherein, as said shaft approaches the respective first and second ends of the stroke, the respective first and second biasing forces are used at least partially to overcome magnetic attraction holding said valve actuating member such that said valve actuating member moves between the first and second magnetically held positions thereby causing the valve element to shift and redirecting the pressurized fluid into the piston chamber to effect reversal of the direction of travel of said shaft.

2. The apparatus of claim 1, wherein said valve shifting mechanism further comprises a first spring for applying the first biasing force and a second spring for applying the second biasing force.

3. The apparatus of claim 2, wherein said valve shifting mechanism further comprises a spool mounted for reciprocation and operatively coupled to said shaft and to said first and second springs, whereby said shaft moves said spool in opposite first and second directions as said shaft approaches the respective first and second ends of the stroke and thereby compresses the first and second springs to impart the first and second biasing forces.

4. The apparatus of claim 1, wherein said magnetic detent device is positioned between said valve and said valve shifting mechanism.

5. The apparatus of claim 1, wherein said valve shifting mechanism is positioned between said valve and said magnetic detent device.

6. Apparatus for pumping heated adhesives, comprising:

a fluid pressure operated pump including a piston chamber, a piston mounted for reciprocation within said piston chamber, and a shaft coupled with said piston such that said piston and said shaft reciprocate together along a stroke having first and second ends;

a valve mounted externally to said piston chamber and capable of operating at temperatures of at least 350° F., said valve configured to selectively direct pressurized fluid into said piston chamber on opposite first and second sides of said piston, said valve including a valve element movable between (i) a first position in which said valve directs the pressurized fluid to said piston chamber on the first side of said piston to move said shaft toward the first end of the stroke, and (ii) a second position in which said valve directs the pressurized fluid to said piston chamber on the second side of said piston to move said shaft toward the second end of the stroke;

a valve shifting mechanism operatively coupling said shaft to said valve element and capable of operating at temperatures of at least 350° F., said valve shifting mechanism including a biasing device providing a first biasing force as said shaft approaches the first end of the stroke and a second biasing force as said shaft approaches the second end of the stroke; and a magnetic detent device capable of operating at temperatures of at least 350° F., and including a valve actuating member coupled to said valve element and moveable between first and second magnetically held positions respectively holding said valve element in its first and second positions, wherein, as said shaft approaches the respective first and second ends of the stroke, the respective first and second biasing forces are used at least partially to overcome magnetic attraction holding said valve actuating member such that said valve actuating member moves between the first and second magnetically held positions thereby causing the valve element to shift and redirecting the pressurized fluid into the piston chamber to effect reversal of the direction of travel of said shaft.

7. The apparatus of claim 6, wherein said valve shifting mechanism further comprises a first spring for applying the first biasing force and a second spring for applying the second biasing force.

8. The apparatus of claim 7, wherein said valve shifting mechanism further comprises a spool mounted for reciprocation and operatively coupled to said shaft and to said first and second springs, whereby said shaft moves said spool in opposite first and second directions as said shaft approaches the respective first and second ends of the stroke and thereby compresses the first and second springs to impart the first and second biasing forces.

9. The apparatus of claim 6, wherein said magnetic detent device is positioned between said valve and said valve shifting mechanism.

10. The apparatus of claim 6, wherein said valve shifting mechanism is positioned between said valve and said magnetic detent device.

11. A method of operating a double stroke piston including a piston coupled with a shaft, the method comprising:

directing pressurized air through a valve including a valve element held in a first position by a first magnetic force, the air being further directed against a first side of the piston to move the shaft toward a first end of a stroke;

actuating a biasing device to apply a first biasing force to the valve element as the shaft approaches the first end of the stroke; and overcoming the first magnetic force with the first biasing force such that the valve element shifts to a second position and air is redirected through the valve and against a second, opposite side of the piston to move the shaft in an opposite direction toward a second end of the stroke.

12. The method of claim 11 further comprising:

holding the valve element in the second position by a second magnetic force;

actuating the biasing device to apply a second biasing force to the valve element as the shaft approaches the second end of the stroke; and overcoming the second magnetic force with the second biasing force such that the valve element shifts back to the first position and air is redirected through the valve and against the first side of the piston to move the shaft back toward the first end of the stroke.

13. A fluid pressure operated piston engine apparatus, comprising:

a fluid pressure operated piston unit including a piston chamber, a piston mounted for reciprocation within said piston chamber, and a shaft coupled with said piston such that said piston and said shaft reciprocate together along a stroke having first and second ends;

a valve configured to selectively direct pressurized fluid into said piston chamber on opposite first and second sides of said piston, said valve including a valve element movable between (i) a first position in which said valve directs the pressurized fluid into said piston chamber on the first side of said piston to move said shaft toward the first end of the stroke, and (ii) a second position in which said valve directs the pressurized fluid into said piston chamber on the second side of said piston to move said shaft toward the second end of the stroke;

a valve shifting mechanism operatively coupling said shaft to said valve element, said valve shifting mechanism including a biasing device providing a first biasing force as said shaft approaches the first end of the stroke and a second biasing force as said shaft approaches the second end of the stroke; and a magnetic detent device including a valve actuating member coupled to said valve element and moveable between first and second magnetically held positions respectively holding said valve element in its first and second positions, wherein, as said shaft approaches the respective first and second ends of the stroke, the respective first and second biasing forces are used at least partially to overcome magnetic attraction holding said valve actuating member such that said valve actuating member moves between the first and second magnetically held positions thereby causing the valve element to shift and redirecting the pressurized fluid into the piston chamber to effect reversal of the direction of travel of said shaft, wherein said magnetic detent device further comprises a fixed magnetic member, and said valve actuating member further comprises first and second spaced apart magnetic members mounted for reciprocation on opposite sides of said fixed magnetic member, said pair of magnetic members coupled for movement with said valve element.

14. The apparatus of claim 13, wherein said fixed magnetic member further comprises a permanent magnet and said first and second spaced apart magnetic members each further comprise a metal plate.

15. The apparatus of claim 13, further comprising first and second resilient bumpers respectively positioned between said first and second spaced apart magnetic members and said fixed magnetic member.

16. Apparatus for pumping heated adhesives, comprising:

a fluid pressure operated pump including a piston chamber, a piston mounted for reciprocation within said piston chamber, and a shaft coupled with said piston such that said piston and said shaft reciprocate together along a stroke having first and second ends;

a valve mounted externally to said piston chamber and capable of operating at temperatures of at least 350° F., said valve configured to selectively direct pressurized fluid into said piston chamber on opposite first and second sides of said piston, said valve including a valve element movable between (i) a first position in which said valve directs the pressurized fluid to said piston chamber on the first side of said piston to move said shaft toward the first end of the stroke, and (ii) a second position in which said valve directs the pressurized fluid to said piston chamber on the second side of said piston to move said shaft toward the second end of the stroke;

a valve shifting mechanism operatively coupling said shaft to said valve element and capable of operating at temperatures of at least 350° F., said valve shifting mechanism including a biasing device providing a first biasing force as said shaft approaches the first end of the stroke and a second biasing force as said shaft approaches the second end of the stroke; and a magnetic detent device capable of operating at temperatures of at least 350° F., and including a valve actuating member coupled to said valve element and moveable between first and second magnetically held positions respectively holding said valve element in its first and second positions, wherein, as said shaft approaches the respective first and second ends of the stroke, the respective first and second biasing forces are used at least partially to overcome magnetic attraction holding said valve actuating member such that said valve actuating member moves between the first and second magnetically held positions thereby causing the valve element to shift and redirecting the pressurized fluid into the piston chamber to effect reversal of the direction of travel of said shaft, wherein said magnetic detent device further comprises a fixed magnetic member, and said valve actuating member further comprises first and second spaced apart magnetic members mounted for reciprocation on opposite sides of said fixed magnetic member, said pair of magnetic members coupled for movement with said valve element.

17. The apparatus of claim 16, wherein said fixed magnetic member further comprises a permanent magnet and said first and second spaced apart magnetic members each further comprise a metal plate.

18. The apparatus of claim 16, further comprising first and second resilient bumpers respectively positioned between said first and second spaced apart magnetic members and said fixed magnetic member.

* * * * *